US006103027A

United States Patent [19]

Glasier, Jr. et al.

[11] Patent Number: 6,103,027

[45] Date of Patent: Aug. 15, 2000

[54] METHOD OF MAKING SEAM FREE WELDED PIPE

[75] Inventors: Louis F. Glasier, Jr., Anaheim; Michael J. Dosdourian, Whittier, both of Calif.

[73] Assignee: Kaiser Aerospace & Electronics Corp., Foster City, Calif.

[21] Appl. No.: 08/968,642

[22] Filed: Nov. 12, 1997

[51] Int. Cl.[7] ..... C21D 8/10

[52] U.S. Cl. ..... 148/593; 148/592; 148/519

[58] Field of Search ..... 148/590, 592, 148/593, 519

[56] References Cited

U.S. PATENT DOCUMENTS 3,222,905 12/1965 Ernestus .
3,274,814 9/1966 Dilling .
3,411,334 11/1968 Ernestus .
3,728,782 4/1973 Ziemek ..... 148/519
4,114,431 9/1978 Monkelbaan .
4,736,607 4/1988 Wochnik .

*Primary Examiner*—Deborah Yee
*Attorney, Agent, or Firm*—Harness, Dickey & Pierce P.L.C.

[57] ABSTRACT

A process for forming a cylindrical pipe from a welded metal pipe stock by roll extruding and annealing whereby the weldment microstructure forming the seam is essentially reformed to provide a recrystallized grain structure which is substantially homogeneous with the parent material of the pipe stock.

16 Claims, 4 Drawing Sheets

PARENT METAL 100X

WELD METAL 100X

Photomicrographs

After STEP B

WELD METAL, 1925°F ANNEAL 100X WELD METAL, 2050°F ANNEAL 100X

Photomicrographs Weld Metal

After STEP D

PARENT METAL 100X

WELD METAL 100X

Photomicrographs

After STEPS E & F

METHOD OF MAKING SEAM FREE WELDED PIPE

SUMMARY BACKGROUND OF THE INVENTION

The present invention relates to the forming of cylindrical metal tubular articles from a welded pipe blank. The present invention provides a unique process for forming an elongated, relatively thin-walled cylindrical tubular article, with enhanced metallurgical characteristics, from a welded pipe blank of considerably greater thickness. The present invention operates on the pipe blank by room temperature roll extrusion to provide a simultaneous reduction of wall thickness and elongation of the tubular wall structure.

It is well known in the art to produce thin walled metallic pipe of a desired length by roll extruding a relatively thick pipe blank into a thin walled pipe of increased length. Such pipes have been formed from wrought or cast seamless pipe blanks. When wrought or cast pipe blanks are utilized,they are formed by various room or elevated temperature processes including roll extrusion into a final seamless thin walled pipe.

On the other hand, when welded pipes fabricated from thick or thin plate stock are utilized as starting blanks, the final result is a thick or thin walled pipe with the seam being defined by the weld; however in the processing of such welded pipe, roll extrusion is not utilized.

Thin walled seamless pipe has superior characteristics, such as uniform strength, corrosion resistance and the like when compared to the thin walled welded pipe. However, there is a significant cost differential between the two, with the seamless pipe being substantially more costly to fabricate than the welded seam pipe. The extra cost is attributable to the higher cost for wrought or cast seamless blanks relative to welded blanks. The present invention is directed to a unique process for forming an essentially seamless pipe from a welded seam pipe blank.

Thus in the present invention the welded pipe blank is processed such that the microstructure of the weld in the pipe becomes substantially obliterated by complete metallurgical recrystallization and chemical homogenization such that it is substantially not distinguishable from the parent metal of the original plate stock. This is essentially seamless or seam free pipe with a wrought equiaxed grain structure. This is accomplished through the application of thermal processing and of controlled mechanical deformation at room temperature of the original welded pipe blank.

The roll, extrusion step where noted above can be performed by apparatus and techniques well known in the tube or pipe forming art. For example the roll extrusion step can be performed by the method and apparatus shown and described in U.S. Pat. No. 3,222,905 issued Dec. 14, 1965 to A. W. Ernestus for "Method Of Forming Tubular Metal Products By Extrusive Rolling". The disclosure of that patent is incorporated herein by reference.

Thus, the present invention provides an improved method of fabricating substantially seam free metal pipes from welded pipe blanks which in comparison to metal pipes as presently made from welded pipe blanks have greatly improved mechanical strength and toughness, and increased corrosion resistance. This is due to the enhanced microstructural uniformity and the elimination of the mechanical and metallurgical notch concentration effects of the weldment.

Thus, it is an object of the present invention to provide a unique process for making a welded metal pipe which is essentially seamless or seam free.

It is another object of the present invention to make such a seamless or seam free pipe from welded pipe stock with the process substantially reforming the weldment seam to have a microstructure substantially the same as the parent material.

Other objects, features, and advantages of the present invention will become apparent from the subsequent description and the appended claims, taken in conjunction with the accompanying drawings, in which:

DETAILED DESCRIPTION OF THE EMBODIMENTS OF THE INVENTION

In the description which follows a number of references are made to terms and specifications well known in the art. For convenience such terms and specifications are set forth in the GLOSSARY OF TERMS AND SPECIFICATIONS following the description.

The process of the present invention can be utilized for the formation of substantially seamless pipe from metals such as stainless steel, titanium, aluminum, or any substantially weldable, ductile metal alloy. In the description which follows the process is utilized with pipe made from ASTM/ASME-A/SA312 austenitic stainless steel. In addition, the process of the present invention can be used with welded pipe blanks covering a wide range of diameters and wall thicknesses.

The welded pipe blank is formed from flat plate stock. After the plate stock is formed into a cylindrical shape, the confronting, axially extending end surfaces are connected by a weldment which is made by fusion welding, with or without filler metal having a composition essentially the same as the parent material of the plate stock. However, the result is a final welded pipe in which the microstructure of the weldment seam is substantially different from that of the parent material. It is the weldment seam which provides the welded seam pipe with the inferior strength, corrosion resistance and other characteristics relative to a seamless pipe. This problem is, to a great extent, overcome by the substantially seam free pipe formed pursuant to the present invention.

For example the process of the present invention can be used to convert ASTM/ASME A/SA312 austenitic stainless steel, welded schedule 40S pipe wall thickness in Nominal Pipe Size (NPS) from 6-inches (6.625-inches) through 24-inches (24.000-inches) in outside diameter to equivalent seamless schedule 5S and 10S pipe wall thickness in Nominal Pipe Size (NPS) from 6-inches (6.625-inches through 24-inches (24.000-inches) in outside diameter (see following table of pipe diameter sizes and wall thickness schedules).

CHART A
NOMINAL PIPE SIZES (NPS) AND SCHEDULES (WALL THICKNESS)

| NPS | Actual OD | Sch 40S | Sch 10S | Sch 5S |
|---|---|---|---|---|
| 6" | 6.625" | 0.280" | 0.134" | 0.100" |
| 8" | 8.625" | 0.322" | 0.148" | 0.100" |
| 10" | 10.750" | 0.365" | 0.165" | 0.134" |
| 12" | 12.750" | 0.375" | 0.180" | 0.156" |
| 14" | 14.000" | 0.375" | 0.188" | 0.156" |
| 16" | 16.000" | 0.375" | 0.188" | 0.165" |
| 18" | 18.000" | 0.375" | 0.188" | 0.165" |
| 20" | 20.000" | 0.375" | 0.218" | 0.188" |
| 22" | 22.000" | 0.375" | 0.250" | 0.218" |
| 24" | 24.000" | 0.375" | 0.250" | 0.218" |

Figure 1:
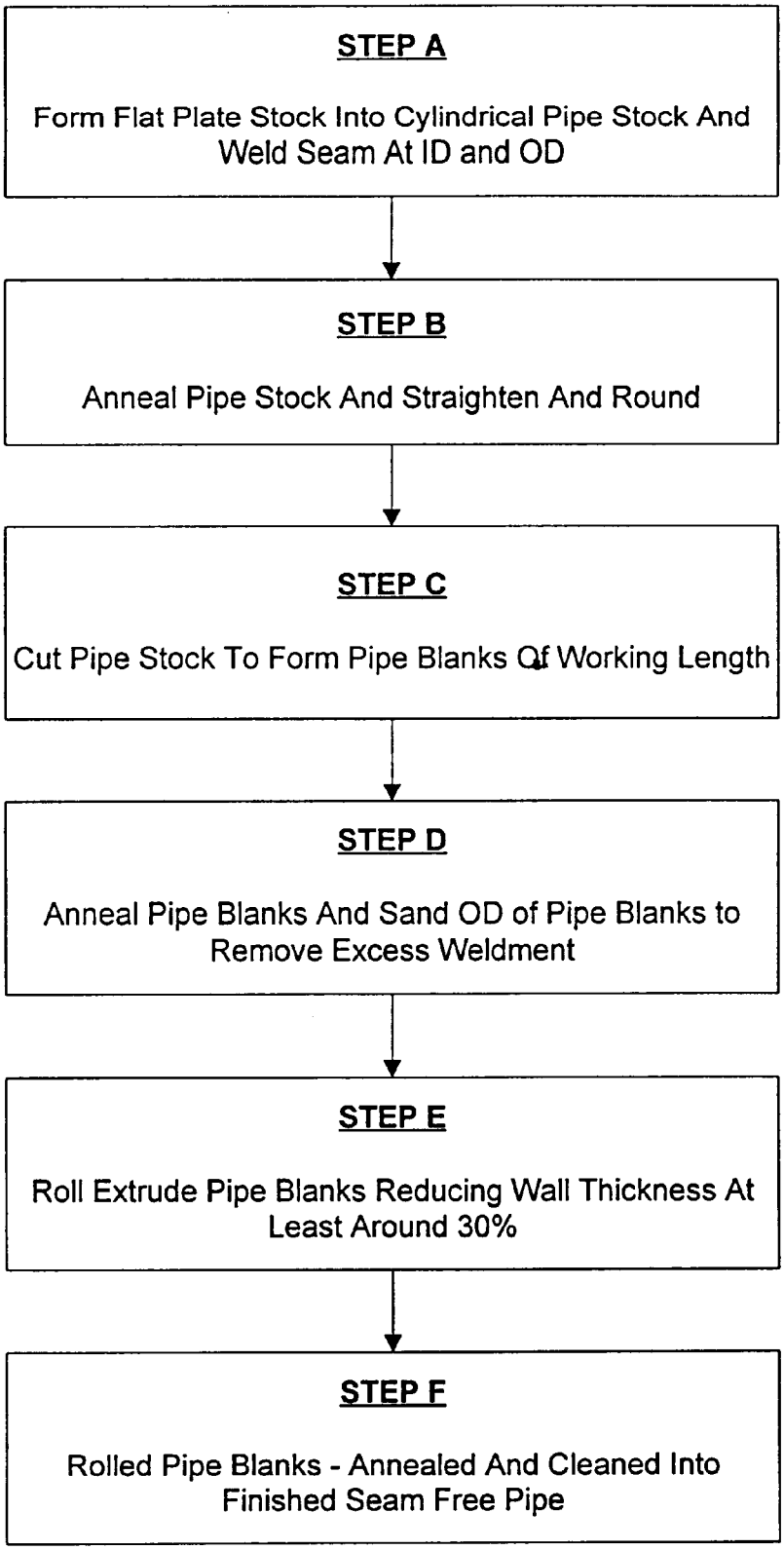
FIG. 1 is a block diagram showing the STEPS A–F utilized in the process of the present invention.

The processing steps to produce the seam free pipe from a welded pipe blank are shown as STEPS A–F in FIG. 1.

Since the apparatus for metal forming of STEPS A, B, C and D is well known in the art, as exemplified by the '905 patent, supra, and since such specific details do not constitute a part of the present invention, such details have been omitted for purposes of simplicity.

STEP A

The schedule 40S welded stainless steel pipe stock is fabricated in compliance with ASTM/ASME-A/SA312, Type 304/304L. The pipe stock is fabricated from flat plate stock, cylindrically formed, gas tungsten arc welded (GTAW) along the confronting end surfaces from both sides (OD & ID) without filler material. The pipe stock, as formed, could typically have a length of around 20 feet.

STEP B

Next, the pipe stock is fully annealed at approximately 1900° F., and rapidly cooled to below 800° F. within approximately 10 minutes. The pipe stock is then straightened and rounded into a circular cross section.

STEP C

The pipe stock, which as noted could be as long as around 20 feet, is cut to various lengths to form pipe blanks of selected lengths. These selected lengths can vary depending upon the final pipe or pipes to be produced.

STEP D

The pipe blanks are then cleaned and fully annealed, between around 1925° F. and 2050° F. for approximately ½ hour, followed by rapid cooling. The pipe blank is then OD sanded to remove the weld metal build up at the weldment seam and to provide a smooth outer surface.

STEP E

Next, the pipe blank is roll extruded at room temperature into thin wall pipe in a manner to be generally described. The roll extruding step could be performed in one pass or several passes depending upon the size of the pipe blank and the final wall thickness and final length desired. As can be seen from CHART A, the wall thickness of the schedule 40S pipe blank is reduced to a schedule 10S wall thickness or further to a schedule 5S wall thickness. Thus, the wall thickness can be typically reduced by at least 30% from the pipe stock to the finally formed pipe blank.

The roll extrusion of STEP E is a room temperature rotary mechanical deformation process in which a rolling tool having a series of circumferentially spaced rotating hardened steel rolls are impressed into the pipe wall thickness from the inside diameter surface of a pipe while the outside diameter of the pipe is restrained by a hardened steel containment or die ring. As the pipe length is withdrawn over the rotating rolls and through the die ring this extrusive rolling reduces the wall thickness of the entire pipe and increases the overall length while maintaining a constant outside diameter. As will be described below, single or multiple reduction steps of the wall thickness may be performed to obtain the desired final wall thickness which provides a resultant mechanical strain from the total wall reduction. Complete recrystallization of the weld is then provided in the subsequent annealing cycle of STEP F.

STEP F

The roll extruded pipe blank is fully annealed to remove the mechanical strain from roll extrusion processing and to further chemically homogenize and recrystallize the weld microstructure to an equiaxed wrought grain structure comparable to the parent (unwelded) metal microstructure.

The as-rolled pipe blanks are cleaned and then fully annealed by being heated to approximately 1925° F., and rapid cooled to below approximately 800° F. within around 10 minutes. The pipes are then descaled, and sanded as required.

Thus, the process can convert stainless steel (ASTM/ASME-A/SA312 Type 304/304L) welded pipe from schedule 40S wall thickness to equivalent seamless and fully wrought schedule 5S and 10S wall thickness pipe blank in 6 through 24 inch Nominal Pipe Sizes (NPS).

The mechanical properties of the converted schedule 10S pipe blanks can meet or exceed all the ASTM/ASME-A/SA312 seamless pipe specification requirements of ultimate tensile, yield strength, and tensile elongation, in the longitudinal and circumferential test directions. The pipe blank can also meet the ASTM/ASME-A/SA312 flatten and guided bend tests.

Additional mechanical requirements such as reverse flattening, flare test, flange test and hardness requirements of ASTM-A249 (a specification for both welded and seamless tubes) can also be met or exceeded.

The schedule 10S stainless steel pipe blank will meet or exceed numerous ASTM corrosion test requirements, such as, Weld Decay corrosion per ASTM-A249 and intergranular corrosion (IGA) tests per ASTM-A 262 practices A, B, C, E and F. In particular, the weld decay test results per ASTM A-249 are significant in that a weld-to-parent metal corrosion ratio as high as 1.25 is considered acceptable while the ratio of the typical seam free pipe processed in accordance with the present invention is less than 1.0. This superior corrosion performance resulted from the recrystallization and homogenization of the weld.

Evaluation of the microstructure of the pipe blank schedule 10S wall thickness pipe blank revealed a wrought structure throughout with ASTM grain sizes ranging from Number 4 to 6 for the parent (unwelded) metal and recrystallized, fully wrought, equiaxed ASTM grain sizes ranging from Number 5 to 6.5 in the weld metal and heat affected zone of the former weldment.

Thus, the substantially seam free pipe can essentially provide all the mechanical properties and superior corrosion resistance of seamless ASTM/ASME-A/SA312 pipe.

In general, and as noted above, the process of the present invention utilizes an extrusion rolling process similar to that as shown and described in U.S. Pat. No. 3,222,905 for "Method Of Forming Tubular Metal Products By Extrusion Rolling" issued Dec. 14, 1965 to A. W. Ernestus. Thus, in the present invention a welded pipe blank that initially is of a relatively short length and thick-walled, e.g. as shown in Chart A, can be roll extruded by apparatus such as that shown and described in the '905 patent, supra. As shown in the '905 patent, an axial pulling force can be applied to the pipe blank via a gripping device in engagement with a coupling groove machined in its inner wall near one end, or an annular inwardly-projecting lip formed at one end of the pipe blank. The pipe blank is then inserted into an annular, ring like sizing die and a draft coupling is inserted into the pipe blank and coupled to the end of the pipe blank either with the gripping device or at the projecting lip. A rolling tool is then applied to the inner surface of the pipe blank and is held in fixed, radially opposed relation to the die ring and a strong axial pull is applied to the end of the pipe blank by a suitable draft unit through the draft coupling. As noted the rolling tool has a series of circumferentially spaced rotatable hardened steel rolls that can be actuated radially outwardly to be compressively engaged with the inside surface of the pipe blank. Thus, the pipe blank is drawn through the die ring while its interior is compressively rolled, thereby enlarging its inside diameter, reducing its wall thickness, extruding it axially with the assistance of the axial pull as it is drawn through the constraining outer die ring.

While the '905 patent shows only a rolling tool with a single set of hardened steel rollers, multiple sets of steel rollers can be used to provide a further reduction in wall thickness. This latter type of construction will facilitate the rolling extrusion of the pipe blank to the desired wall thickness and length in one pass through the rolling tool and die ring.

Figure 2:
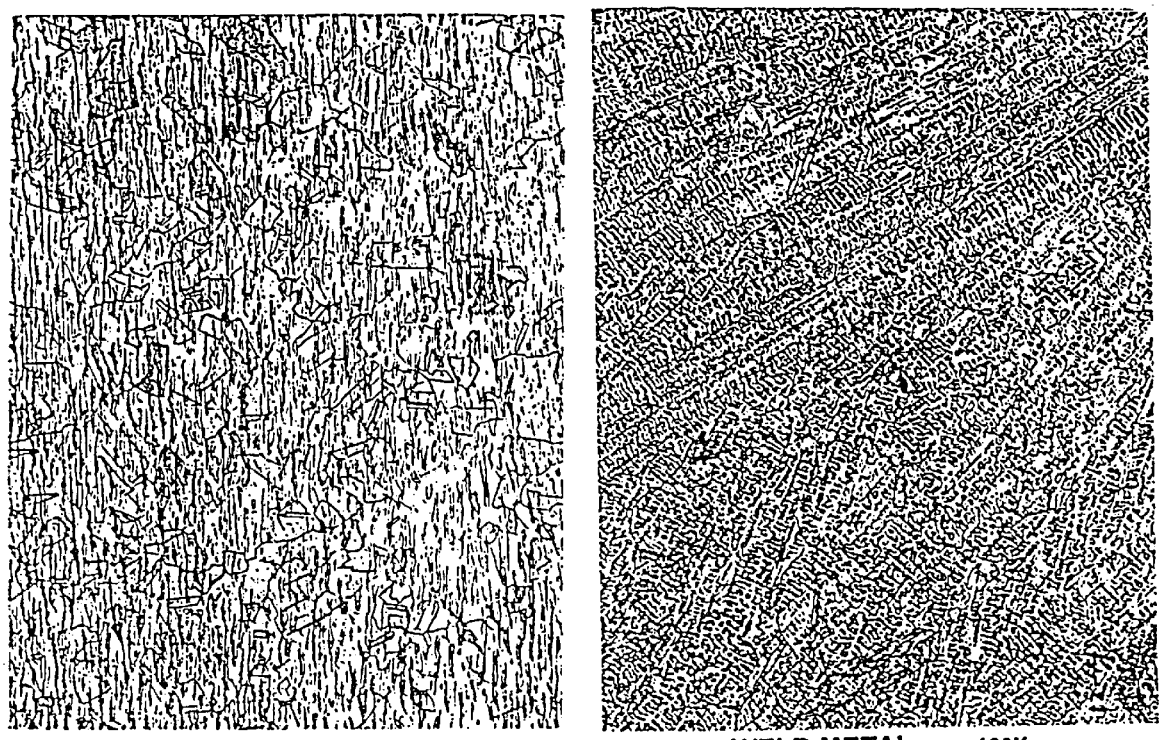
FIG. 2 is photomicrographs to one hundred times size of a Schedule 40S pipe stock after STEP B and showing the different grain structure as between the parent metal and the weld metal.
Figure 3:
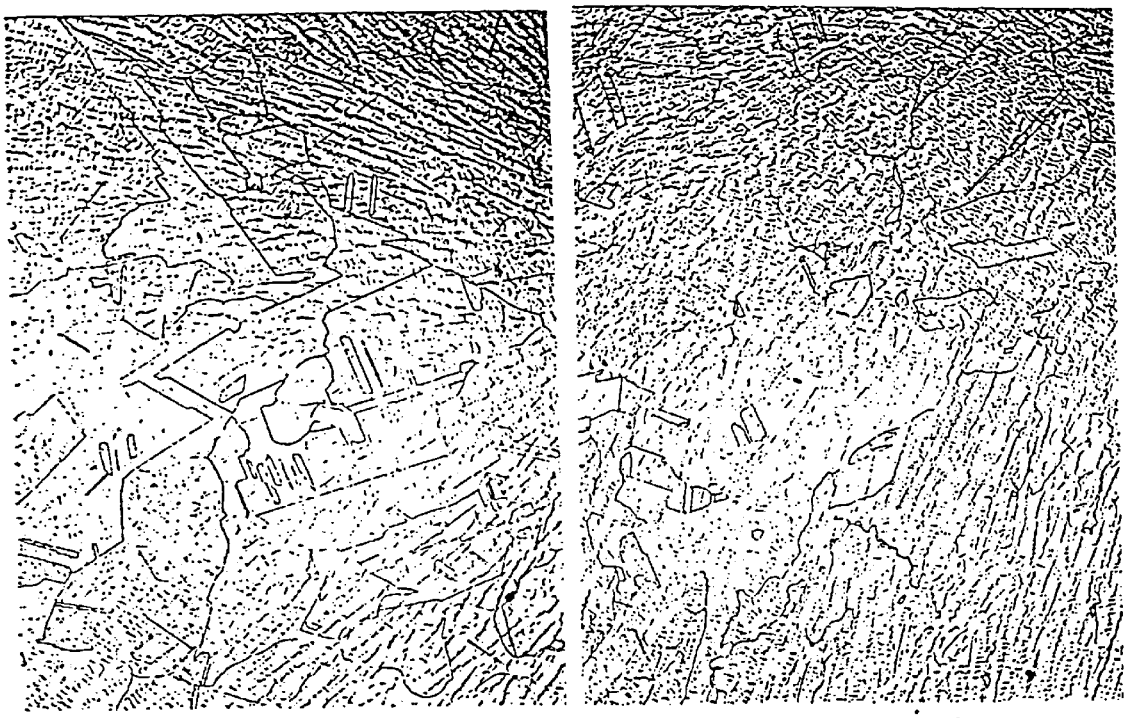
FIG. 3 is photomicrographs to one hundred times size of the pipe stock of FIG. 2 after the further annealing step of STEP D and showing the grain structures of the weld metal at two different annealing temperatures.
Figure 4:
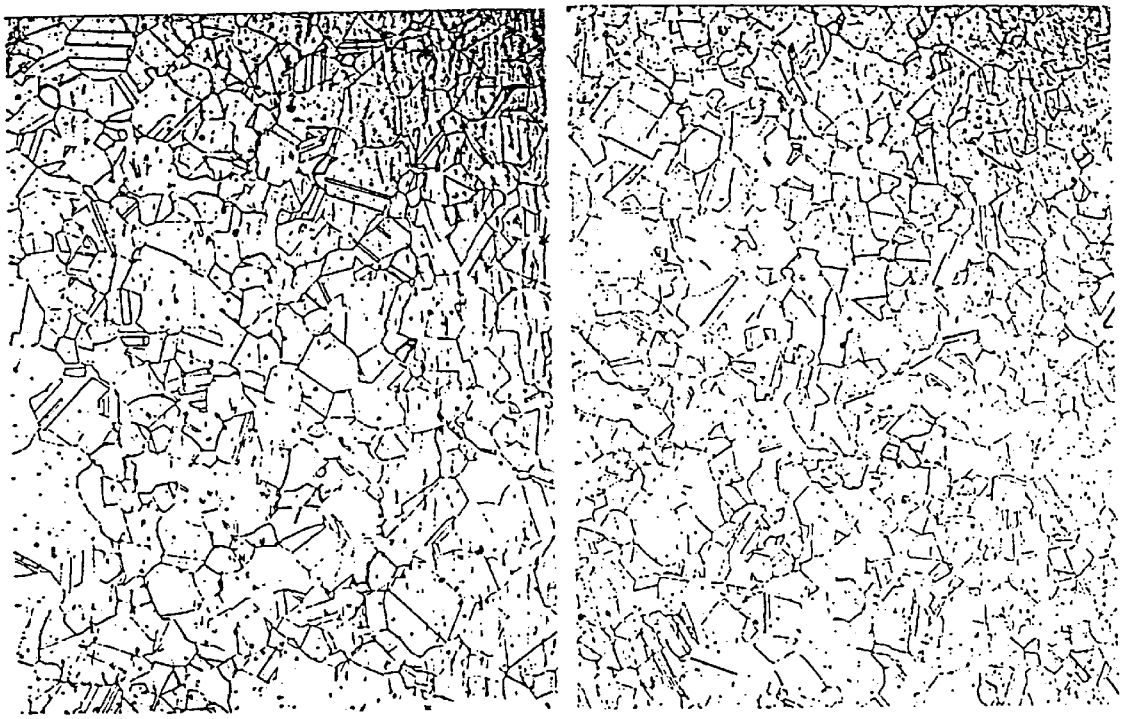
FIG. 4 is photomicrographs to one hundred times size of the pipe blank formed from the pipe stock of FIG. 2 after the roll extrusion of STEP E and annealing of STEP F.

The result of the above described process is the essential obliteration of the weld seam by the substantially complete metallurgical recrystallization and chemical homogenization whereby the weldment and parent material are essentially of the same grain structure. This can be seen from the photomicrographs of FIGS. 2–4 of the process as applied to the welded stainless steel pipe stock as noted. Thus, FIG. 2 clearly shows the different grain structures between the material of the weld seam and that of the parent metal. FIG. 3 shows a significant degree of uniformity between the grain structure of the material of the weldment and the parent material due to recrystallization (compare FIG. 3 to FIG. 2). Finally, after the process has been completed, the grain structure of the material of the weldment and that of the parent metal are substantially metallurgically uniform in grain structure (see FIG. 4). Thus, the process of the present invention effectively converts welded pipe stock into a finished, equivalent seamless pipe blank.

While the above description has been made with regard to stainless steel, it should be understood that the process can be applied to other ferrous materials, as well as other metals such as titanium, aluminum and other substantially weldable and ductile metals. It should also be understood that while the preceding description noted the conversion of the pipe stock of schedule 40S wall thickness to schedule 10S wall thickness, the process could be applied, as well, to conversion from schedule 40S wall thickness to schedule 5S wall thickness or other similar reductions.

While it will be apparent that the preferred embodiments of the invention disclosed are well calculated to fulfill the objects stated above, it will be appreciated that the invention is susceptible to modification, variation and change without departing from the proper scope or fair meaning of the invention.

GLOSSARY OF TERMS AND SPECIFICATIONS

1. ASTM-A312 austenitic stainless steel: An American Society for Testing and Materials (ASTM) specification entitled, "Seamless and Welded Austenitic Stainless Steel Pipe", representing forty-four (44) grades of austenitic stainless steel, including grades of type 304 and 316 compositions. "Austenitic" refers to the metallurgical structure of the alloys.
2. ASME-SA312 austenitic stainless steel: An American Society of Mechanical Engineers (ASME) specification entitled, "Seamless and Welded Austenitic Stainless Steel Pipes", essentially identical to ASTM-A312.
3 Schedule 40S, 10S, etc.: Schedule refers to the wall thickness of the pipe blank.
4. OD: OD refers to the outside diameter of the pipe.
5. ID: ID refers to the inside diameter of the pipe.
6. Nominal Pipe Size (NPS): NPS refers to the outside diameter of a pipe for pipes up to and including 12 inches. The inside diameter (ID) for pipes up to an including 12 inches is additionally approximately equal to the NPS. 14 inch pipes and greater also refer to the outside diameter of the pipe as the nominal pipe size.
7. Equiaxed Wrought Grain Structure: Equiaxed grain structure refers to a microstructure consisting of grains having length, width and height dimensions of approximately the same size. The grain size of an alloy generally is a relative measurement of the agglomeration size of coalesced atomic crystals. Wrought refers to the processing history of the grains of the pipe where the pipe has been developed by subsequent mechanical working, such as forging, hammering, and extrusion, as opposed to the grains being in a cast condition.
8. Weld Decay ASTM-A249: This test is directed towards tubing, but is also used with welded pipe. The test, however, is not required for welded pipe. The test includes submersing pipe samples in boiling 20% hydrochloric acid for a sufficient time to remove 40 to 60% of the base metal. The average reduction in weld metal thickness is compared to base metal thickness, where a ratio of 1.25 or less is acceptable.
9. IGA (Intergranular Attack) Corrosion Testing per ASTM-A262, Practices A, B, C, E and F.: A series of chemical exposure tests that determines if a stainless steel is sensitized to intergranular (grain boundary) attack in various corrosive environments due to chemistry and the thermal-mechanical history of the pipe.

What is claimed is:

1. The method of fabricating metal pipe from weldable and ductile metals comprising the steps of:

utilizing a tubular pipe stock of a preselected length formed into a cylindrical shape from flat plate stock and having a weld seam formed from the parent material of the plate stock for joining the confronting ends of the cylindrically formed plate stock, cutting said pipe stock to form pipe blanks of a desired length, substantially full annealing said pipe blanks followed by rapid cooling and removing excess weldment from the outer surface of said pipe blank, roll extruding said pipe blanks to form rolled pipe blanks of an increased length while reducing the wall thickness by at least around 30%, and substantially full annealing said rolled pipe blanks followed by rapid cooling to remove mechanical strain resulting from the roll extrusion and to reform the grain structure of the weldment to be comparable to the metal microstructure of the parent non-welded material whereby the rolled pipe blanks are finished seam free pipe.

2. The method of claim 1 with said metal pipe blanks being made of austenitic stainless steel.

3. The method of claim 1 with said weldment as reformed having an equiaxed wrought grain structure comparable to the grain structure of the parent metal microstructure as fully annealed.

4. The method of claim 1 with said metal pipe blanks being made of an ASTM/ASME-A/SA312 austenitic stainless steel.

5. The method of claim 1 with said metal pipe blanks being made of austenitic stainless steel, said weldment as reformed having an equiaxed wrought grain structure comparable to the grain structure of the parent metal microstructure as fully annealed.

6. The method of fabricating metal pipe from weldable and ductile metals comprising the steps of:

forming a tubular pipe stock of a preselected length into a cylindrical shape from a flat plate stock and having a weld seam formed from the parent material of the plate stock for joining the confronting ends of the cylindrically formed plate stock, fully annealing said formed pipe stock followed by rapid cooling, straightening and rounding said pipe stock into a circular cross section;

substantially full annealing said pipe stock followed by rapid cooling and removing excess weldment from the outer surface of said pipe stock, roll extruding said pipe stock to form a rolled pipe stock of an increased length while reducing the wall thickness by at least around 30%, and substantially full annealing said rolled pipe stock followed by rapid cooling stock to remove mechanical strain resulting from the roll extrusion and to reform the grain structure of the weldment to be comparable to the metal microstructure of the parent non-welded material whereby said rolled pipe stock is finished seam free pipe.

7. The method of claim 6 with said metal pipe stock being made of austenitic stainless steel.

8. The method of claim 6 with said weldment as reformed having an equiaxed wrought grain structure comparable to the grain structure of the parent metal microstructure as fully annealed.

9. The method of claim 6 with said metal pipe blanks being made of an ASTM/ASME-A/SA312 austenitic stainless steel.

10. The method of claim 6 with said metal pipe blanks being made of austenitic stainless steel, said weldment as reformed having an equiaxed wrought grain structure comparable to the grain structure of the parent metal microstructure as fully annealed.

11. The method of fabricating metal pipe from weldable and ductile metals comprising the steps of:

forming a tubular pipe stock of a preselected length into a cylindrical shape from a flat plate stock and having a weld seam formed from the parent material of the plate stock for joining the confronting ends of the cylindrically formed plate stock, fully annealing said formed pipe stock followed by rapid cooling, straightening and rounding said pipe stock into a circular cross section, cutting said pipe stock to form pipe blanks of a desired length, substantially full annealing said pipe blanks followed by rapid cooling and removing excess weldment from the outer surface of said pipe blank, roll extruding said pipe blanks to form rolled pipe blanks of an increased length while reducing the wall thickness by at least around 30%, and substantially full annealing said rolled pipe blanks followed by rapid cooling to remove mechanical strain resulting from the roll extrusion and to reform the grain structure of the weldment to be comparable to the metal microstructure of the parent non-welded material whereby the rolled pipe blanks are finished seam free pipe.

12. The method of claim 11 with said metal pipe blanks being made of austenitic stainless steel.

13. The method of claim 11 with said weldment as reformed having an equiaxed wrought grain structure comparable to the grain structure of the parent metal microstructure as fully annealed.

14. The method of claim 11 with said metal pipe blanks being made of austenitic stainless steel, said weldment as reformed having an equiaxed wrought grain structure comparable to the grain structure of the parent metal microstructure as fully annealed.

15. The method of fabricating metal pipe from weldable and ductile metals comprising the steps of:

forming a tubular pipe stock made of austenitic stainless steel and of a preselected length into a cylindrical shape from a flat plate stock and having a weld seam formed from the parent material of the plate stock for joining the confronting ends of the cylindrically formed plate stock, fully annealing said pipe stock at approximately 1900° F. followed by rapid cooling, cutting said pipe stock to form pipe blanks of a desired length, cleaning said pipe blanks and substantially full annealing said pipe blanks at between around 1925° F. and 2050° F. followed by rapid cooling, removing excess weldment from the outer surface of said pipe blank, roll extruding said pipe blanks to form rolled pipe blanks of an increased length while reducing the wall thickness by at least around 30%, and substantially full annealing said rolled pipe blanks at approximately 1925° F. followed by rapid cooling to remove mechanical strain resulting from the roll extrusion and to reform the grain structure of the weldment to be comparable to the metal microstructure of the parent non-welded material whereby the rolled pipe blanks are finished seam free pipe.

16. The method of claim 15 with said weldment as reformed having an equiaxed wrought grain structure comparable to the grain structure of the parent metal microstructure as fully annealed.

* * * * *

UNITED STATES PATENT AND TRADEMARK OFFICE

CERTIFICATE OF CORRECTION

PATENT NO. : 6,103,027
DATED : August 15, 2000
INVENTOR(S) : L. F. Glasier, Jr. & M. J. Dosdourian

It is certified that error appears in the above-identified patent and that said Letters Patent is hereby corrected as shown below:

Col. 7, line 49, Claim 9, delete "blanks" and substitute therefor --stock--.

Col. 7, line 52, Claim 10, delete "blanks" substitute therefor --stock--.

Col. 8, line 8, Claim 11 delete "blank" and substitute therefor --blanks--.

Col. 8, line 47, Claim 15 delete "blank" and substitute therefor --blanks--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*